US007721559B2

(12) United States Patent
Choi et al.

(10) Patent No.: US 7,721,559 B2
(45) Date of Patent: May 25, 2010

(54) MULTI-TYPE AIR CONDITIONER AND METHOD FOR CONTROLLING THE SAME

(75) Inventors: Jae Heuk Choi, Seoul (KR); Yoon Been Lee, Seoul (KR); Baik Young Chung, Incheon-si (KR); Se Dong Chang, Gwangmyeong-si (KR); Hyung Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1225 days.

(21) Appl. No.: 11/274,329

(22) Filed: Nov. 16, 2005

(65) Prior Publication Data

US 2006/0117776 A1 Jun. 8, 2006

(30) Foreign Application Priority Data

Nov. 17, 2004 (KR) ..... 10-2004-0093983

(51) Int. Cl.

| | |
|---|---|
| ***F25B 7/00*** | (2006.01) |
| ***F25B 1/00*** | (2006.01) |
| ***F25B 1/10*** | (2006.01) |
| ***F04B 23/04*** | (2006.01) |

(52) U.S. Cl. ..... 62/175; 62/228.5; 62/510; 417/533

(58) Field of Classification Search ..... 62/228.1, 62/228.3, 228.5, 175, 510, 498; 417/7, 533
See application file for complete search history.

(56) References Cited

U.S. PATENT DOCUMENTS

| | | | | |
|---|---|---|---|---|
| 3,581,519 | A * | 6/1971 | Garrett et al. | 62/468 |
| 6,125,642 | A | 10/2000 | Seener et al. | |
| 6,722,156 | B2 * | 4/2004 | Tanimoto et al. | 62/510 |
| 2003/0066302 | A1 | 4/2003 | Ueno | |

FOREIGN PATENT DOCUMENTS

| | | | |
|---|---|---|---|
| EP | 0 838 640 | A2 | 4/1998 |
| JP | 1-203677 | | 8/1989 |
| JP | 1-203848 | A | 8/1989 |
| JP | 03286198 | A * | 12/1991 |
| JP | 8-128764 | A | 5/1996 |
| JP | 08128764 | A * | 5/1996 |
| JP | 8-200854 | A | 8/1996 |
| JP | 8-200856 | A | 8/1996 |
| JP | 08200854 | A * | 8/1996 |
| JP | 08200856 | A * | 8/1996 |
| JP | 2000046419 | A * | 2/2000 |
| WO | WO-2004/076945 | A1 | 9/2004 |

* cited by examiner

*Primary Examiner*—Chen-Wen Jiang
(74) *Attorney, Agent, or Firm*—Birch, Stewart, Kolasch & Birch, LLP

(57) ABSTRACT

Multi-type air conditioner including a plurality of compressors, a plurality of temperature sensors mounted in the plurality of compressors for sensing temperatures in the compressors respectively, and an equalizing pipe in communication with the plurality of compressors, for uniform distribution of oil among the plurality of compressors according to the temperatures sensed at the plurality of temperature sensors respectively, thereby distributing oil among the compressors uniformly at an exact time point at which the oil is distributed among the compressors non-uniformly, not only to permit improvement of the performance of the compressors, but also to permit improvement performance of the air conditioner having the compressors.

15 Claims, 8 Drawing Sheets

MULTI-TYPE AIR CONDITIONER AND METHOD FOR CONTROLLING THE SAME

CROSS-REFERENCE TO RELATED APPLICATION

This application claims the benefit of Korean Application No. P2004-93983, filed on Nov. 17, 2004, which is hereby incorporated by reference as if fully set forth herein.

BACKGROUND OF THE INVENTION

1. Field of the Invention

The present invention relates to air conditioner, and more particularly, to a multi-type air conditioner and a method for controlling same, which can improve reliability of a compressor and system efficiency.

2. Discussion of the Related Art

In general, the air conditioner cools or/and heats rooms as the air conditioner performs steps of compression, condensing, expansion, and evaporation of refrigerant. In air conditioning systems, there are cooling air conditioner for supplying cold air to the room by operating a refrigerating cycle only in one direction, and cooling/heating air conditioner for supplying cold or warm air to the room by operating the refrigerating cycle in either direction, selectively.

Moreover, there are general air conditioners in which one indoor unit is connected to one outdoor unit, and multi-type air conditioners in which a plurality of indoor units are connected to one outdoor unit. In the meantime, the multi-type air conditioner may have one of more than one outdoor unit.

The multi-type air conditioner having one of more than one outdoor unit is provided with at least one compressor mounted on the outdoor unit. As the compressor, a single speed compressor of which operating frequency is constant, or a variable speed compressor of which operating frequency varies, is used.

However, the multi-type air conditioner having an outdoor unit with a plurality of compressors mounted thereon has the following problems.

That is, if the air conditioner is put into operation, there has been a problem of non-uniform distribution of oil among the plurality of compressors caused by differences of suction pressures of the compressors. Consequently, a compressor having a relative shortage of oil experiences drop of performance, to impair reliability. If the compressor is operated continuously in a state of oil shortage, the compressor is liable to burn. Moreover, the drop of performance of the compressor leads to drop an overall efficiency of the multi-type air conditioner, resulting to impair a cooling/heating performance.

SUMMARY OF THE INVENTION

Accordingly, the present invention is directed to a multi-type air conditioner and a method for controlling same that substantially obviates one or more problems due to limitations and disadvantages of the related art.

An object of the present invention is to provide a multi-type air conditioner and a method for controlling same, in which an oil distribution among compressor is made uniform at an exact time the oil is distributed non-uniformly among the compressors, for improving the compressor performance, to improve a performance of the air conditioner.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a multi-type air conditioner includes a plurality of compressors, a plurality of temperature sensors mounted in the plurality of compressors for sensing temperatures in the compressors, respectively, and an equalizing pipe in communication with the plurality of compressors, for uniform distribution of oil among the plurality of compressors according to the temperatures sensed at the plurality of temperature sensors respectively.

Preferably, the temperature sensors are mounted adjacent tb ends of the equalizing pipe, respectively.

The ends of the equalizing pipe may be positioned at heights at least higher than a lowest oil level of the compressors, and the equalizing pipe may include branch pipes in communication with the plurality of compressors.

The multi-type air conditioner may further include a strainer in the equalizing pipe for separating foreign matters from flowing oil.

The plurality of compressors may include a variable capacity compressor of which capacity varies, and other one single speed compressor which is driven at a constant speed.

The multi-type air conditioner may further include a plurality of oil separators in communication with the plurality of compressors for separating oil from refrigerant from the compressors respectively, and a plurality of oil return pipes respectively connected between the oil separators and compressors for guiding oil separated at the oil separators to the compressors. The oil return pipes may be respectively connected to refrigerant suction pipes of the compressors into which refrigerant is drawn.

The multi-type air conditioner may further include strainers in the oil return pipes for separating foreign matters from flowing oil.

In the meantime, in another aspect of the present invention, a multi-type air conditioner includes at least one outdoor unit having a plurality of compressors for compressing refrigerant, at least one indoor unit connected to the outdoor unit with refrigerant pipes, a plurality of temperature sensors mounted in the plurality of compressors for sensing temperatures in the compressors, respectively, and an equalizing pipe in communication with the plurality of compressors, for uniform distribution of oil among the plurality of compressors according to the temperatures sensed at the plurality of temperature sensors respectively.

Preferably, the temperature sensors are mounted adjacent to the equalizing pipe in communication with insides of the compressors, respectively.

The ends of the equalizing pipe are positioned at heights at least higher than a lowest oil level of the compressors, and, if the multi-type air conditioner has one outdoor unit, the equalizing pipe may include branch pipes in communication with the plurality of compressors, and, if the multi-type air conditioner has a plurality of outdoor units, the equalizing pipe may include branch pipes in communication with the plurality of compressors in respective outdoor units, and connection pipes for making the plurality of the outdoor units in communication between the branch pipes.

The multi-type air conditioner may further include a strainer in the equalizing pipe for separating foreign matters from flowing oil.

If the multi-type air conditioner has a plurality of outdoor units, one of the outdoor units includes the plurality of compressors having a variable capacity compressor of which capacity varies, and other one single speed compressor which is driven at a constant speed, and other one of the outdoor units includes the plurality of compressors having the single speed compressors.

The multi-type air conditioner may further include a plurality of oil separators in communication with the plurality of compressors for separating oil from refrigerant from the compressors respectively, and a plurality of oil return pipes respectively connected between the oil separators and compressors for guiding oil separated at the oil separators to the compressors. The oil return pipes are respectively connected to refrigerant suction pipes of the compressors into which refrigerant are drawn.

The multi-type air conditioner may further include strainers in the oil return pipes for separating foreign matters from flowing oil.

Preferably, the refrigerant pipes connected between the outdoor unit and the indoor unit are parallel.

In another aspect of the present invention, a method for controlling a multi-type air conditioner having at least one outdoor unit having a plurality of compressors for compressing refrigerant, at least one indoor unit connected to the outdoor unit with refrigerant pipes, a plurality of temperature sensors mounted in the plurality of compressors for sensing temperatures in the compressors respectively, and an equalizing pipe in communication with the plurality of compressors, for uniform distribution of oil among the plurality of compressors according to the temperatures sensed at the plurality of temperature sensors respectively, includes a sensing step of sensing temperatures of insides of the plurality of compressors with the plurality of temperature sensors respectively, a comparing step of comparing the temperatures of the insides of the compressors sensed thus to preset critical temperatures of the compressors respectively, and an operation step of distributing oil uniformly among the plurality of compressors according to a result of the comparison.

The operation step is performed if there is at least one temperature below the critical temperature in the temperatures sensed with the temperature sensors, and the operation step includes the step of operating the plurality of compressors alternately for a preset time period.

The critical temperature is a temperature inside of the compressor when an amount of oil stored in the compressor is a minimum amount the compressor requires.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A multi-type air conditioner in accordance with a first preferred embodiment of the present invention will be described, with reference to FIGS. 1 to 5.

Figure 1:
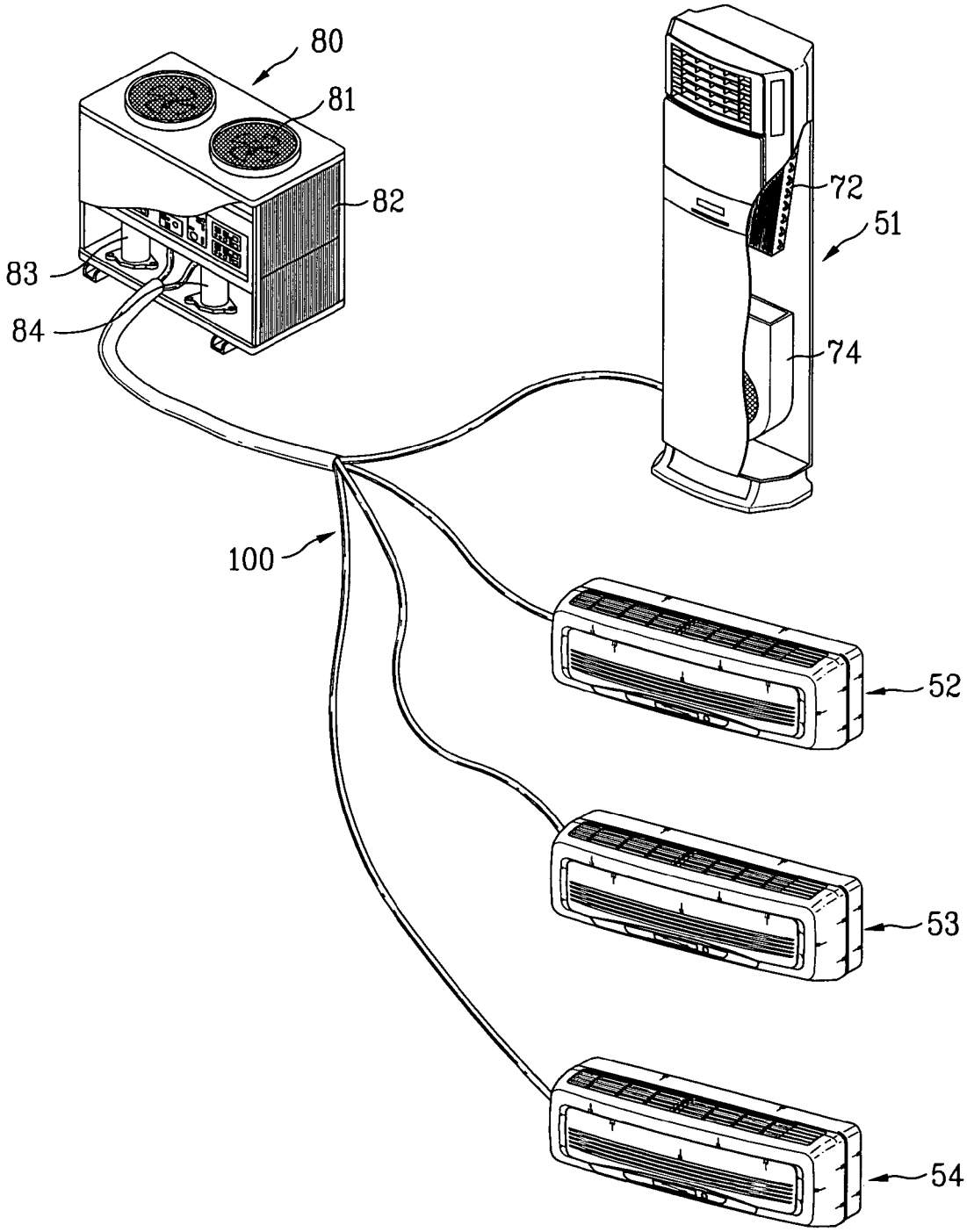
FIG. 1 illustrates a perspective view of a multi-type air conditioner in accordance with a first preferred embodiment of the present invention, with partial cut away views.

Referring to FIG. 1, the multi-type air conditioner includes one outdoor unit 80, a plurality of indoor units 51, 52, 53, and 54, and refrigerant pipelines 100 connected between the outdoor unit 80 and the indoor units 51, 52, 53, and 54.

The plurality of indoor units 51, 52, 53, and 54 are connected in parallel to the outdoor unit 80 in parallel with the refrigerant pipelines 100. That is, refrigerant flow between the outdoor unit 80 and the indoor units 51, 52, 53, and 54 is made through the refrigerant pipelines 100.

Figure 2:
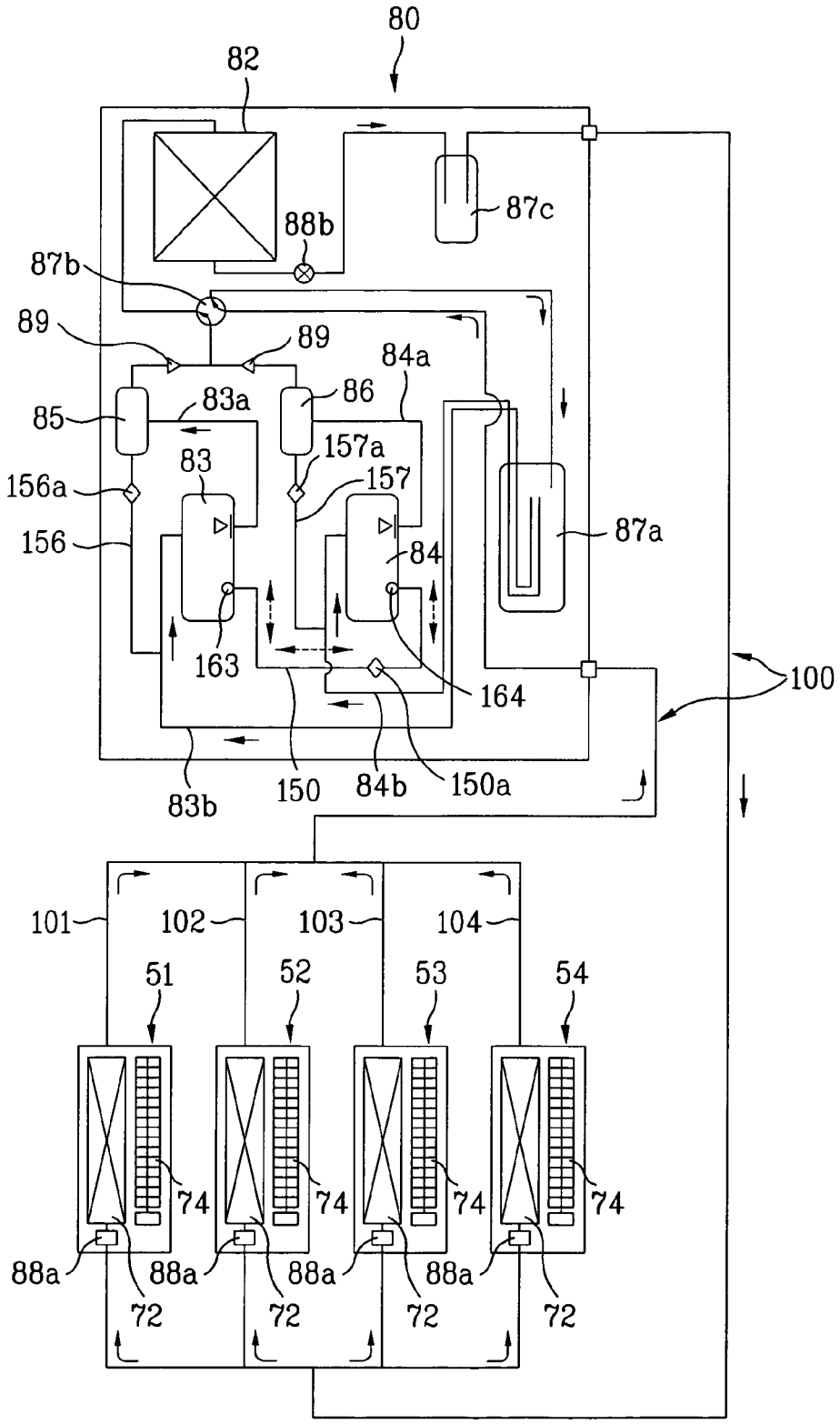
FIG. 2 illustrates a diagram of the multi-type air conditioner in accordance with a first preferred embodiment of the present invention during cooling operation, schematically.

Referring to FIG. 2, the indoor unit 51, 52, 53, or 54 includes an indoor fan 74 for drawing air from a room and discharging the air to the room again, and an indoor heat exchanger 72 for making the air drawn into the indoor unit 51, 52, 53, or 54 to heat exchange with refrigerant, to cool or heat the air.

In the meantime, referring to FIG. 2, the outdoor unit 80 includes an outdoor fan 81 (see FIG. 1) for drawing outdoor air therein and discharging the outdoor air again, an outdoor heat exchanger 82 for making the air drawn by the outdoor fan 81 to heat exchange with refrigerant, a plurality of compressors 83, and 84 for compressing refrigerant, and a plurality of oil separators 85, and 86 connected to refrigerant discharge pipes 83*a*, and 84*a* of the compressors 83, and 84 for separating oil from refrigerant from the compressor 83, and 84, respectively.

Though not shown, the compressor 83, or 84 includes a compression unit having a compression chamber for compressing refrigerant, a motor unit for compressing the compression chamber, and an oil pump for pumping oil for lubrication of the motor unit or the compression unit. When the compressor discharges high temperature, and high pressure gaseous refrigerant, the oil is discharged together with the refrigerant, most of which is separated at the oil separator 85, or 86, and returns to a refrigerant suction pipe 83*b*, or 84*b* of the compressor 83, or 84, such that some of the oil circulates the refrigerating cycle together with refrigerant.

It is preferable that the compressors 83, and 84 include a variable capacity compressor 83 having a variable capacity, and a single speed compressor 84 which is driven at a constant speed, so that, if a load on the indoor units 51, 52, 53, and 54 is low, for an example, in a case one or two of the plurality of indoor units 51, 52, 53, and 54 is in operation, only the variable capacity compressor 83 may be operated in correspondence to the load on the indoor unit 51, 52, 53, and 54, and, if the load on the indoor units 51, 52, 53, and 54 is relatively high, for an example, in a case three or four of the plurality of indoor units 51, 52, 53, and 54 are in operation, the single speed compressor 84 is operated together with the variable capacity compressor 83.

An unexplained reference numeral 87*a* denotes a common accumulator in the outdoor unit 80 connected to the refrigerant suction pipes 83*b* and 84*b* of the variable capacity compressor 83 and the signal speed compressor 84, for accumulating liquid refrigerant so that only gaseous refrigerant is introduced into the variable capacity compressor 83 and the single speed compressor 84. An unexplained reference numeral 87*b* denotes a 4-way valve in the outdoor unit 80 for changing over a flow path such that refrigerant from the oil separator flows either to the indoor heat exchanger or the outdoor heat exchanger 82 so that the plurality of indoor units 51, 52, 53, and 54 can be used as coolers or heaters. An unexplained reference numeral 87*c* denotes a receiver in the outdoor unit 80 for storing surplus refrigerant, and making only liquid refrigerant to circulate toward an indoor unit side in cooling operation. An unexplained reference numeral 88*a* denotes an expansion device, such as an orifice or an electronic expansion valve, or so on, on the refrigerant pipeline 100 between the outdoor heat exchanger 82 and the indoor heat exchangers 72 for expanding refrigerant passed through the outdoor heat exchanger 82 or the indoor heat exchanger 72 to low temperature, and low pressure refrigerant. An unexplained reference numeral 88*b* denotes an electronic expansion valve on the outdoor unit for controlling a flow passage of the refrigerant for controlling a flow rate of the refrigerant circulating through the refrigerating cycle. An unexplained reference numeral 89 denotes a check valve on each of the refrigerant discharge pipes 83*a*, and 84*a* of the variable capacity compressor 83 and the single speed compressor 84 for preventing reverse flow of the refrigerant or the oil.

Figure 3:
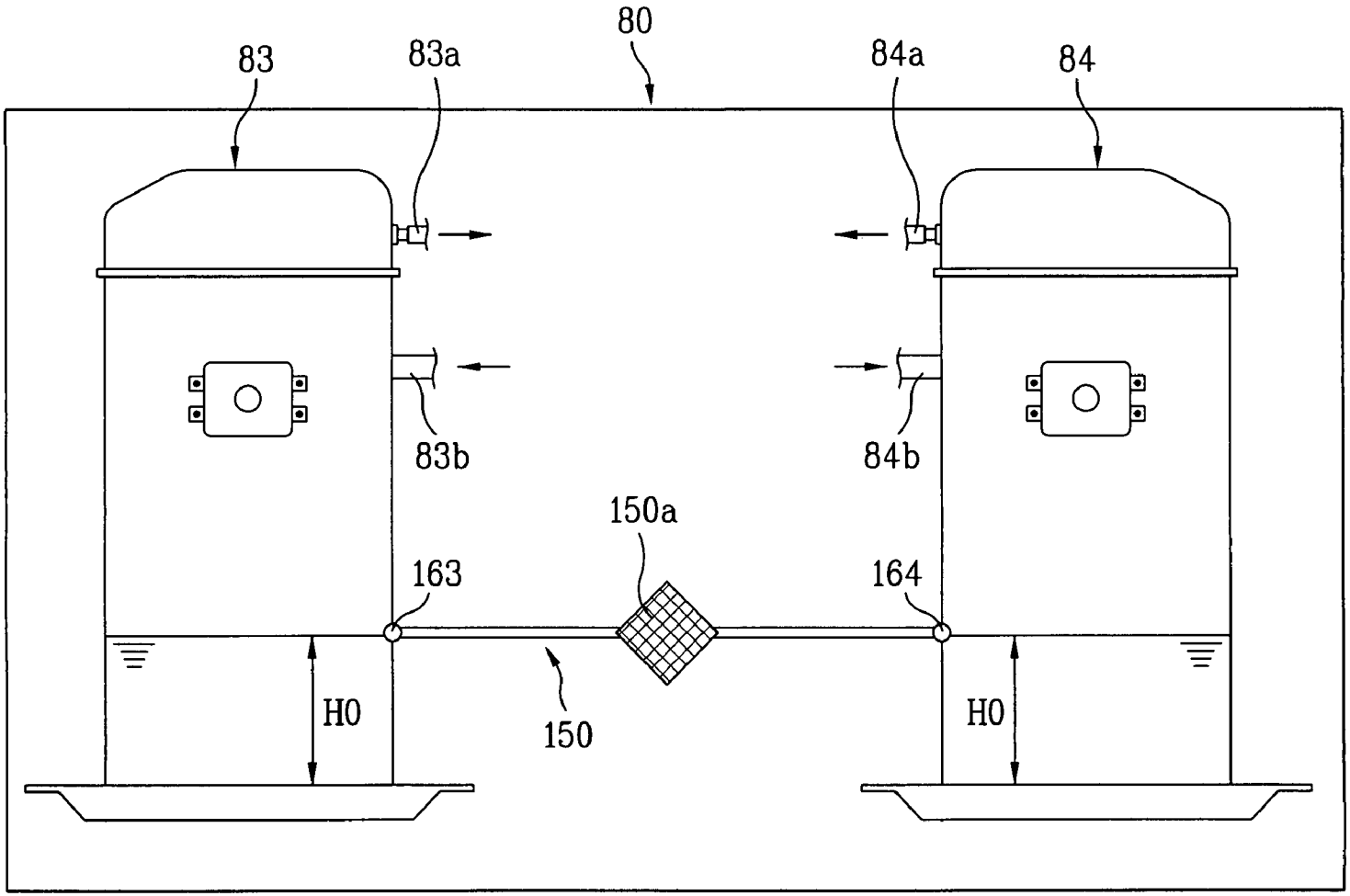
FIG. 3 illustrates key parts of an equalizing pipe arrangement between compressors in FIG. 2, schematically.

In the meantime, referring to FIG. 3, the multi-type air conditioner further includes temperature sensors 163, and 164 in the compressors respectively, for sensing inside temperatures of the compressors 83, and 84 respectively, and an equalizing pipe 150 in communication with the compressors 83, and 84 for making uniform distribution of oil between the compressors 83, and 84 according to the temperatures sensed at the temperature sensors 163, and 164.

The temperature sensors 163, and 164 are mounted adjacent to ends of the equalizing pipe 150, respectively. That is, it is preferable that the temperature sensors 163, and 164 are mounted at opposite ends of the equalizing pipe 150, respectively.

The opposite ends of the equalizing pipe 150 are connected to position at a height at least higher than a lowest limit H0 of an oil level of the compressors 83, and 84. It is preferable that the opposite ends of the equalizing pipe 150 are positioned at a height higher than the lowest limit H0 of the oil level of the compressors 83, and 84. If there are three of more than three compressors in the outdoor unit, it is preferable that the equalizing pipe 150 is designed to be in communication with the compressors, to serve as a distribution pipe which prevents the oil from concentrating on one of the compressors, but makes the oil distributed among all the compressors. It is more preferable that a strainer 150*a* is further provided in the equalizing pipe 150 for separating foreign matters from flowing oil.

In the meantime, the oil separated at the oil separators 85, and 86 returns to the compressors 83, and 84 through oil return pipes 156, and 157 connected between the oil separators 85, and 86, and the refrigerant suction pipes 83*b*, and 84*b* of the compressors 83, and 84, respectively.

It is preferable that strainers 156*a*, and 157*a* are mounted on the oil return pipes 156, and 157 for separating foreign matters from the oil.

A method for controlling the foregoing multi-type air conditioner in accordance with a first preferred embodiment of the present invention will be described. For reference, if refrigerant is made to circulate in a direction of the outdoor heat exchanger 82, the expansion device 88*a*, and the indoor heat exchanger 72 starting from the compressors 83, and 84 by means of the 4-way valve 87*b*, the multi-type air conditioner forms a cooling cycle such that the indoor units 51, 52, 53, and 54 cool rooms. If the refrigerant flow is changed over by means of the 4-way valve 87*b* such that the refrigerant flows in a reverse direction of the cooling, a heating cycle is formed such that the indoor units 51, 52, 53, and 54 heat rooms. Accordingly, in the following description, only a case will be described, in which the multi-type air conditioner forms the cooling cycle.

If the multi-type air conditioner is operated such that some of the plurality of indoor units 51, 52, 53, and 54 are in cooling operation, for an example, one or two of the indoor units 51, 52, 53, and 54 is in cooling operation, the multi-type air conditioner operates the variable capacity compressor 83 only in the outdoor unit 80, leaving the single speed compressor 83 in the outdoor unit 80 stationary.

Accordingly, the variable capacity compressor 83 compresses the refrigerant to a high temperature, high pressure refrigerant and discharges to the refrigerant discharge pipe 83*a* together with the oil, and most of the oil is separated from the refrigerant as the discharged refrigerant and oil passes through the oil separator 85, and a portion of the oil circulates the refrigerating cycle together with the refrigerant.

That is, the refrigerant passed through the oil separator 85 passes through the 4-way valve 87*b*, the outdoor heat exchanger 82, the expansion device 88*a* in succession, and is introduced into the indoor heat exchanger of the indoor unit in cooling operation, vaporizes while cooling air around the indoor unit 72 such that the indoor unit serves as a cooler, and returns to the variable capacity compressor 83.

The oil separated at the oil separator 85 returns to the refrigerant suction pipe 83*b* of the variable capacity compressor 83 through the oil return pipe 156, and, therefrom to the variable capacity compressor 83 together with the refrigerant returning to the variable capacity compressor 83.

In the meantime, the multi-type air conditioner causes a non-uniform distribution of oil between the compressors 83, and 84 as oil in the refrigerating system concentrates on the variable capacity compressor 83 if operation of the variable capacity compressor 83 is continued for a long time period.

In this instance, the multi-type air conditioner of the present invention performs an operation in which the oil is distributed uniformly between the compressors 83, and 84 at an exact time point through the equalizing pipe 150 and the temperature sensors 163, and 164 at the opposite ends of the equalizing pipe 150, for preventing wear and noise from the compressors 83, and 84, extending lifetimes of the compressor 83, and 84, and improving a system efficiency.

Figure 4:
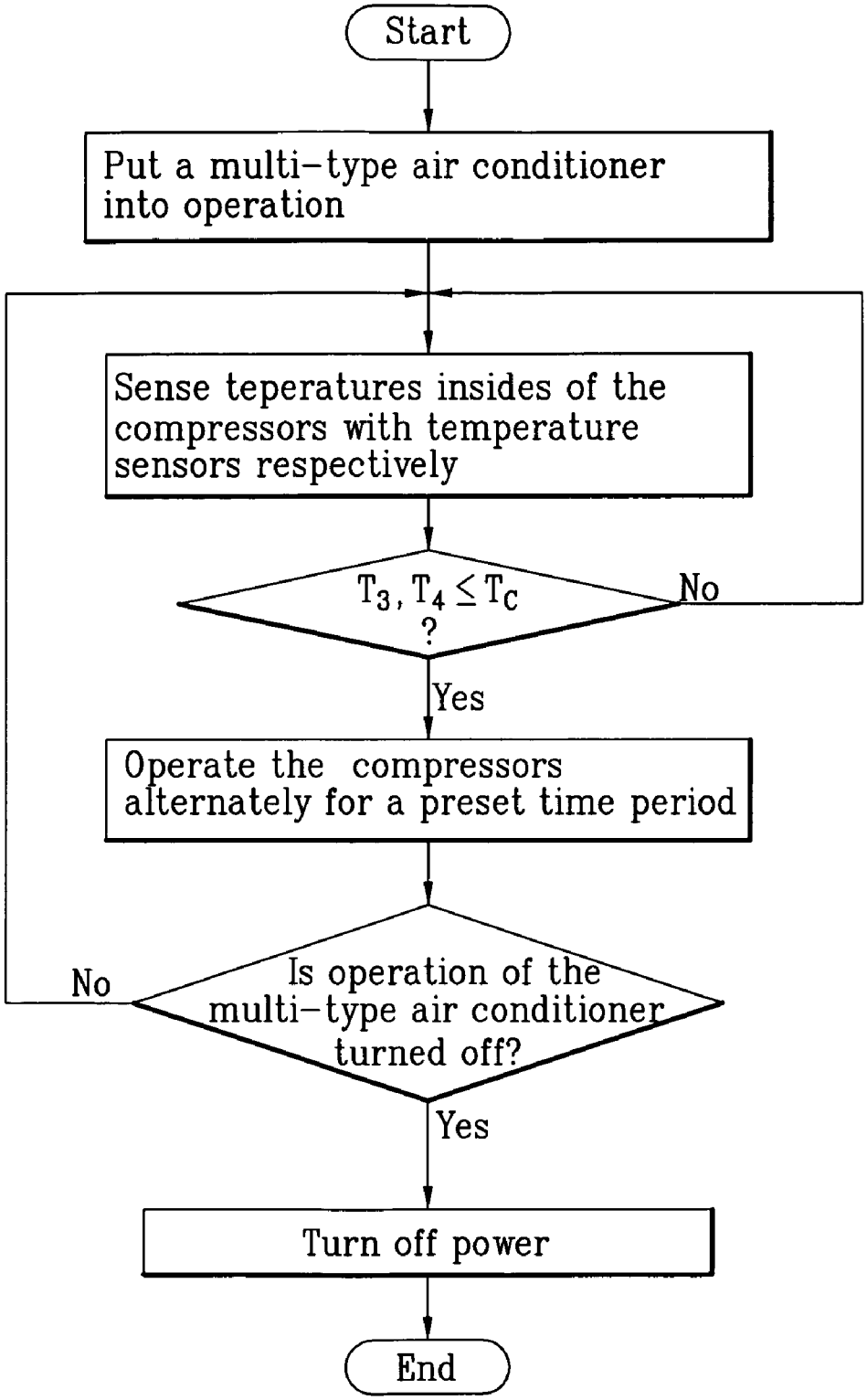
FIG. 4 illustrates a flow chart showing the steps of a method for controlling a multi-type air conditioner in accordance with a first preferred embodiment of the present invention.

That is, referring to FIG. 4, upon putting the multi-type air conditioner in accordance with a first preferred embodiment of the present invention into operation, the temperature sensors 163, and 164 at the opposite ends of the equalizing pipe 150 sense temperatures inside of the compressors 83, and 84, respectively.

Then, the control unit (not shown) compares the temperatures T3, and T4 of the compressors 83, and 84 sensed with the temperature sensors 163, and 164 to a preset critical temperature Tc of the compressors 83, and 84. The critical temperature Tc is an inside temperature of the compressor 83, or 84 when an amount of oil stored in the compressor 83, or 84 is a minimum amount the compressor 83, or 84 requires.

Accordingly, if one of the temperatures T3, and T4 of the compressors 83, or 84 drops below the critical temperature Tc of the compressors 83, and 84, an operation is performed for a predetermined time period to make oil distribution between the compressor 83, and 84 uniform.

For an example, by operating the compressors 83, and 84 alternately for the predetermined time period, the oil is transferred from the compressor 83 on which the oil is concentrated to the compressor 84 which has shortage of oil.

Thus, by performing the operation for uniform distribution of oil between the compressors 83, and 84 at the exact time point at which the oil is distributed between the compressors 83, and 84 non-uniformly, not only the performance of the compressor 83, and 84 can be improved, but also system efficiency of the air conditioner having the compressors 83, and 84 can be improved.

Figure 5:
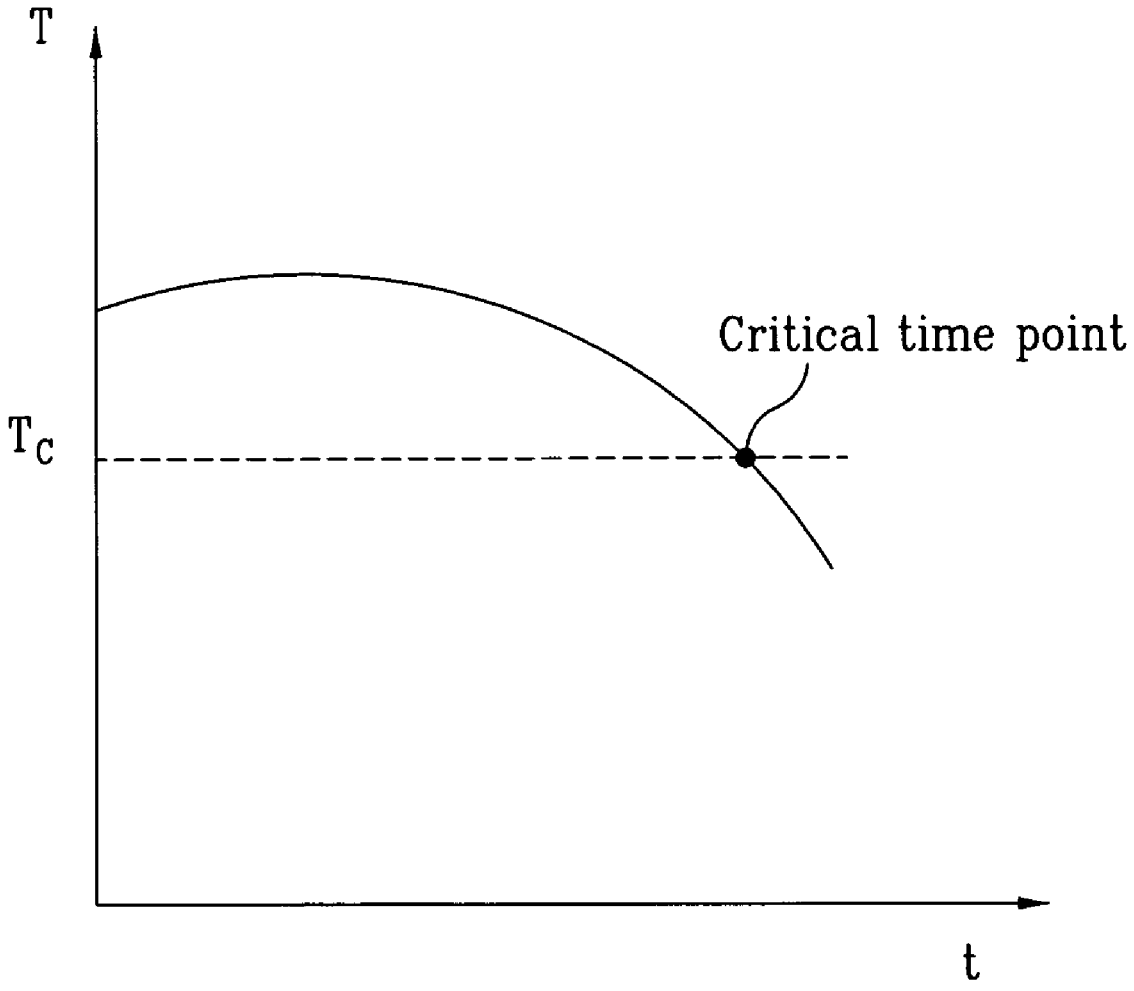
FIG. 5 illustrates a graph showing a critical temperature Tc of a compressor, and a correlation between a compressor internal temperature T and time, of a multi-type air conditioner of the present invention.

For reference, a principle of a method for equalizing oil between the compressors of the present invention will be described, with reference to FIG. 5.

During operation of the compressors, mixture of gaseous refrigerant, and oil is held in the compressor, and an amount of oil in the compressor which is relatively stationary is reduced gradually, leading to drop a concentration of oil in the compressor.

Once the oil concentration drops, a pressure in the compressor drops, leading to drop the inside temperature of the compressor, too.

Accordingly, by defining a temperature in the compressor in a case a minimum required quantity of oil is held in the compressor as a critical temperature Tc of the compressor, and a time point when the temperature T of the inside of the compressor is below the critical temperature Tc as a critical time point, the operation for equalizing oil between the compressors is performed, if the compressor at the critical time point is at least one.

In the meantime, the multi-type air conditioner operates both the variable capacity compressor 83 and the single speed compressor 84 in correspondence to the load on the indoor units 51, 52, 53, and 54, if three or four of the indoor units 51, 52, 53, and 54 are operated.

In this case, by the method for equalizing oil between the compressors 83, and 84, an operation for distributing oil between the compressors 83, and 84 uniformly is performed at an exact time point the non-uniform oil distribution occurs between the compressors 83, and 84, thereby preventing wear down and drop of performance of the compressors, and improving system efficiency of the air conditioner having the compressors.

Next, a multi-type air conditioner in accordance with a second preferred embodiment of the present invention will be described with reference to FIGS. 6 to 8.

Figure 6:
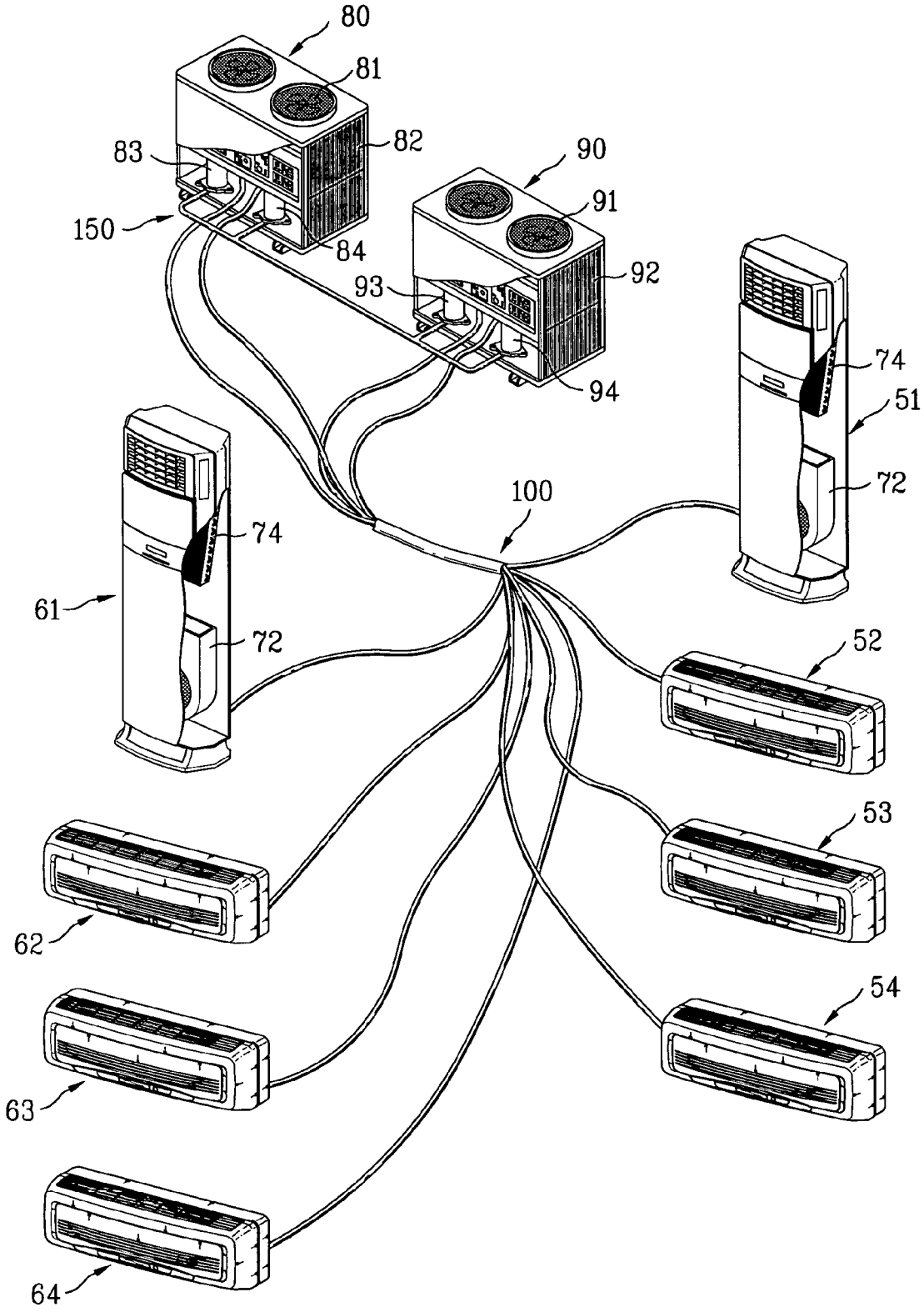
FIG. 6 illustrates a perspective view of a multi-type air conditioner in accordance with a second preferred embodiment of the present invention, with partial cut away views.

Referring to FIG. 6, the multi-type air conditioner includes a plurality of outdoor units 80, and 90, a plurality of indoor units 51, 52, 53, 54, 61, 62, 63, and 64, and refrigerant pipelines 100 connected between the indoor units 51, 52, 53, 54, 61, 62, 63, and 64, and the outdoor units 80, and 90.

Figure 7:
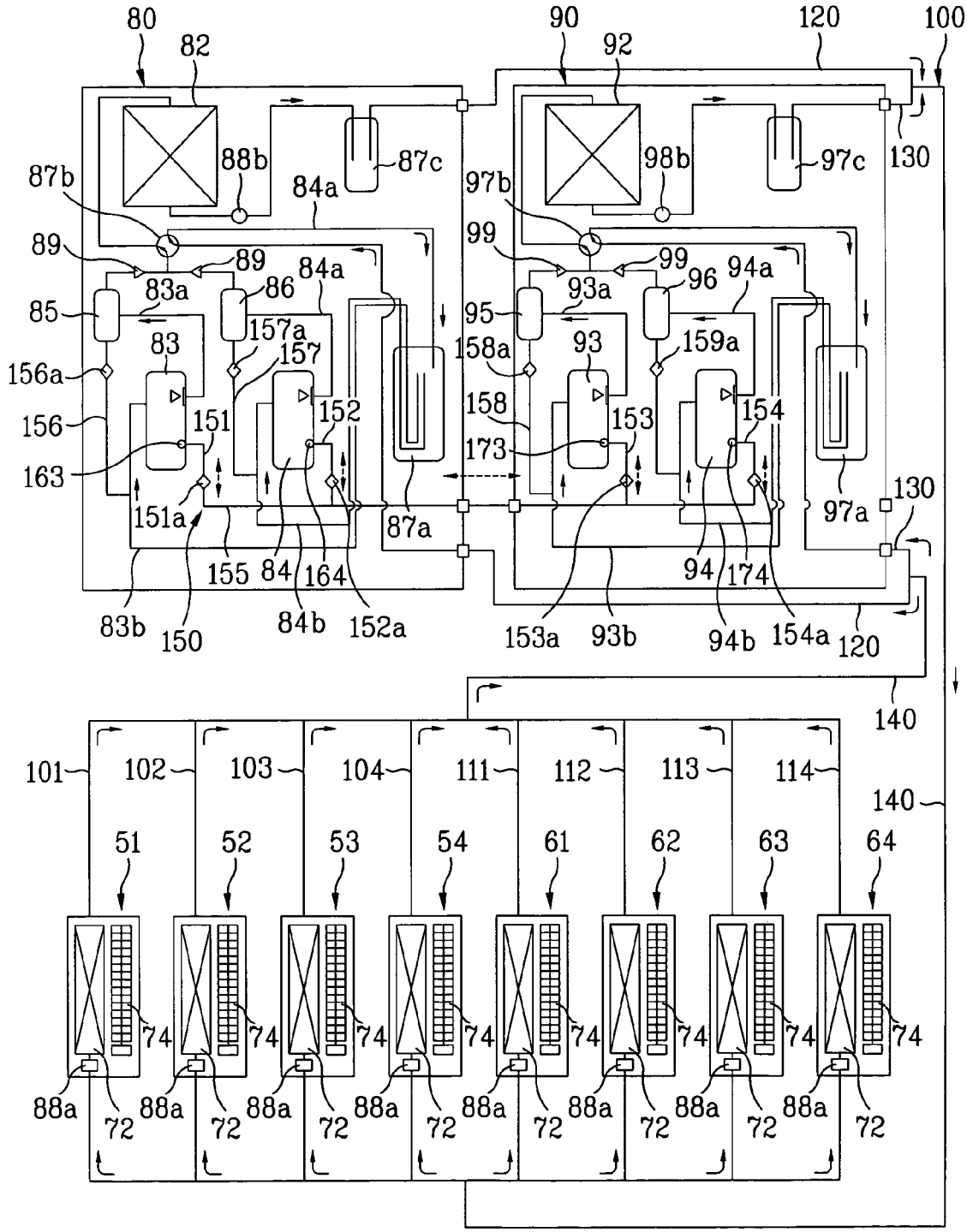
FIG. 7 illustrates a diagram of the multi-type air conditioner in accordance with a second preferred embodiment of the present invention during cooling operation, schematically.

Referring to FIG. 7, the refrigerant pipelines 100 include a plurality of indoor unit connection pipes 101, 102, 103, 104, 111, 112, 113, and 114 respectively connected to the indoor units 51, 52, 53, 54, 61, 62, 63, and 64, a plurality of outdoor unit connection pipes 120, and 130 respectively connected to the outdoor units 80, and 90, and indoor/outdoor connection pipes 140 respectively connected between the indoor unit connection pipes 101, 102, 103, 104, 111, 112, 113, and 114 and the connection pipes 120, and 130, to connect the plurality of indoor units 51, 52, 53, 54, 61, 62, 63, and 64 to the plurality of outdoor units 80, and 90 in parallel.

The refrigerant passed through the indoor units 51, 52, 53, 54, 61, 62, 63, and 64 joins at the indoor/outdoor connection pipes 140, and distributed to the outdoor units 80, and 90, and the refrigerant passed through the outdoor units 80, and 90 joins at the indoor/outdoor connection pipes 140, and distributed to the indoor units 51, 52, 53, 54, 61, 62, 63, and 64.

Moreover, each of the indoor units 51, 52, 53, 54, 61, 62, 63, and 64 has an indoor fan 72 for drawing air from a room and discharging the air to the room again, and an indoor heat exchanger 74 for making the air drawn into the indoor unit to heat exchange with the refrigerant, to cool or heat the room.

In the meantime, though the present invention is not limited to numbers of the outdoor units 80, and 90, and the indoor units 51, 52, 53, 54, 61, 62, 63, and 64, for convenience sake, the description of the multi-type air conditioner in accordance with a second preferred embodiment of the present invention will be proceeded with two outdoor units 80, and 90, and eight indoor units 51, 52, 53, 54, 61, 62, 63, and 64, taken as an example.

Referring to FIG. 7, the outdoor unit 80 includes an outdoor fan 81 (see FIG. 6) for drawing outdoor air therein and discharging the outdoor air again, an outdoor heat exchanger 82 for making the air drawn by the outdoor fan 81 to heat exchange with refrigerant, a plurality of compressors 83, and 84 for compressing refrigerant, and a plurality of oil separators 85, and 86 connected to refrigerant discharge pipes 83*a*, and 84*a* of the compressors 83, and 84 for separating oil from refrigerant from the compressor 83, and 84, respectively.

In the meantime, though not shown, the compressor 83, or 84 includes a compression unit having a compression chamber for compressing refrigerant, a motor unit for compressing the compression chamber, and an oil pump for pumping oil for lubrication of the motor unit or the compression unit. When the compressor discharges high temperature, and high pressure gaseous refrigerant, the oil is discharged together with the refrigerant, most of which is separated at the oil separator 85, or 86, and returns to a refrigerant suction pipe 83*b*, or 84*b* of the compressor 83, or 84, such that some of the oil circulates the refrigerating cycle together with refrigerant.

It is preferable that the compressors 83, and 84 include a variable capacity compressor 83 having a variable capacity, and a first single speed compressor 84 which is driven at a constant speed, so that, if a load on the indoor units 51, 52, 53, 54, 61, 62, 63, and 64 is low, for an example, in a case one or two of the plurality of indoor units 51, 52, 53, 54, 61, 62, 63, and 64 is in operation, only the variable capacity compressor 83 may be operated in correspondence to the load on the indoor unit 51, 52, 53, 54, 61, 62, 63, and 64, and, if the load on the indoor units 51, 52, 53, 54, 61, 62, 63, and 64 is relatively high, for an example, in a case three or four of the plurality of indoor units 51, 52, 53, 54, 61, 62, 63, and 64 are in operation, the first single speed compressor 84 is operated together with the variable capacity compressor 83.

An unexplained reference numeral 87*a* denotes a common accumulator in the first outdoor unit 80 connected to the refrigerant suction pipes 83*b* and 84*b* of the variable capacity compressor 83 and the first signal speed compressor 84, for accumulating liquid refrigerant so that only gaseous refrigerant is introduced into the variable capacity compressor 83 and the first single speed compressor 84. An unexplained reference numeral 87*b* denotes a 4-way valve in the first outdoor unit 80 for changing over a flow path such that refrigerant from the oil separators 85, and 86 flows either to the indoor heat exchanger 74 or the outdoor heat exchanger 82 so that the plurality of indoor units 51, 52, 53, 54, 61, 62, 63, and 64 can be used as coolers or heaters. An unexplained reference numeral 87*c* denotes a receiver in the first outdoor unit 80 for storing surplus refrigerant, and making only liquid refrigerant to circulate toward an indoor unit side in cooling operation. An unexplained reference numeral 88*a* denotes an expansion device, such as an orifice or an electronic expansion valve, or so on, on the refrigerant pipeline 100 between the outdoor heat exchanger 82 and the indoor heat exchangers 72 for expanding refrigerant passed through the outdoor heat exchanger 82 or the indoor heat exchanger 72 to low temperature, and low pressure refrigerant. An unexplained reference numeral 88*b* denotes an electronic expansion valve on the first outdoor unit for controlling a flow passage of the refrigerant for controlling a flow rate of the refrigerant circulating through the refrigerating cycle. An unexplained reference numeral 89 denotes a check valve on each of the refrigerant discharge pipes 83*a*, and 84*a* of the variable capacity compressor 83 and the first single speed compressor 84 for preventing reverse flow of the refrigerant or the oil.

Referring to FIG. 7, system and operation of an outdoor fan 91 (see FIG. 6), indoor an outdoor heat exchanger 92, oil separators 95, 96, a common accumulator 97*a*, a 4-way valve 97*b*, a receiver 97*c*, an electronic expansion valve, and a check valve of the second outdoor unit 90 are the same with the first outdoor unit 80, except the compressors 93, and 94 for compressing refrigerant, detailed description thereof will be omitted.

It is preferable that the compressor of the second outdoor unit 90 includes second, and third single speed compressors 93, and 94, operated selectively depending on a load on the indoor units 51, 52, 53, 54, 61, 62, 63, and 64.

That is, if the load on the indoor units 51, 52, 53, 54, 61, 62, 63, and 64 is high, for an example, five or six of the indoor units 51, 52, 53, 54, 61, 62, 63, and 64 are in operation, the second single speed compressor 93 may be operated together with the variable capacity compressor 83, and the first single speed compressor 84, and if the load on the indoor units 51, 52, 53, 54, 61, 62, 63, and 64 is maximum, for an example, seven or eight of the indoor units 51, 52, 53, 54, 61, 62, 63, and 64 are in operation, the third single speed compressor 94 may be operated, together with the variable speed compressor 83, the first single speed compressor 84, and the second single speed compressor 93.

In the meantime, referring to FIG. 3, the multi-type air conditioner further includes temperature sensors 163, 164, 173, and 174 in the compressors 83, 84, 93, and 94 respectively, for sensing inside temperatures of the compressors 83, 84, 93, and 94 respectively, and an equalizing pipe 150 in communication with the compressors 83, 84, 93, and 94 for making uniform distribution of oil among the compressors 83, 84, 93, and 94 according to the temperatures sensed at the temperature sensors 163, 164, 173, and 174.

The equalizing pipe 150 is in communication with the variable capacity compressor 83, the first single speed compressor 84, the second single speed compressor, and the third single speed compressor, to prevent the oil from concentrating on one of the compressors 83, 84, 93, and 94, and to make the oil distributed among all the compressors 83, 84, 93, and 94. The equalizing pipe 150 includes a plurality of branch pipes 151, 152, 153, and 154, and a connection pipe 155 between the outdoor units 80, and 90 to make the branch pipes 151, and 152, and the branch pipes 153, and 154 in communication. Ends of the branch pipes 151, 152, 153, and 154 are connected to position at a height at least higher than a lowest limit of an oil level of the compressors 83, 84, 93, and 94. It is preferable that the ends of the branch pipes 151, 152, 153, and 154 are positioned at a height higher than the lowest limit of the oil level of the compressors 83, 84, 93, and 94. It is more preferable that strainers 151*a*, 152*a*, 153*a*, and 154*a* are further provided in the branch pipes 151, 152, 153, and 154 respectively, for separating foreign matters from flowing oil.

The temperature sensors 163, 164, 173, and 174 are respectively mounted in the compressors 83, 84, 93, and 94 adjacent to the ends of the branch pipes 151, 152, 153, and 154 in communication with insides of the compressors 83, 84, 93, and 94.

In the meantime, the oil separated at the oil separators 85, 86, 95, and 96 returns to the compressors 83, 84, 93, and 94 through oil return pipes 156, 157, 158, and 159 connected between the oil separators 85, 86, 95, and 96 and the refrigerant suction pipes 83*b*, 84*b*, 93*b*, and 94*b* of the compressors 83, 84, 93, and 94, respectively.

It is preferable that strainers 156*a*, 157*a*, 158*a*, and 159*a* are mounted in the oil return pipes 156, 157, 158, and 159 for separating foreign matters from the oil.

A method for controlling the foregoing multi-type air conditioner in accordance with a second preferred embodiment of the present invention will be described. For reference, if refrigerant is made to circulate in a direction of the outdoor heat exchanger 82, and 92, the expansion device 88*a*, and the indoor heat exchanger 72 starting from the compressors 83, 84, 94, and 95 by means of the 4-way valves 87*b*, and 97*b*, the multi-type air conditioner forms a cooling cycle such that the indoor units 51, 52, 53, 54, 61, 62, 63, and 64 cool rooms. If the refrigerant flow is changed over by means of the 4-way valves 87*b*, and 97*b* such that the refrigerant flows in a reverse direction of the cooling, a heating cycle is formed such that the indoor units 51, 52, 53, 54, 61, 62, 63, and 64 heat rooms. Accordingly, in the following description, only a case will be described, in which the multi-type air conditioner forms the cooling cycle.

If the multi-type air conditioner is operated such that some of the plurality of indoor units 51, 52, 53, 54, 61, 62, 63, and 64 are in cooling operation, for an example, one of the indoor units 51, 52, 53, 54, 61, 62, 63, and 64 is in cooling operation, the multi-type air conditioner operates the variable capacity compressor 83 only in the outdoor unit 80, leaving the first single speed compressor 83 in the first outdoor unit 80, the second, and third single speed compressors 93, and 94 in the second outdoor unit 90 stationary.

The variable capacity compressor 83 compresses the refrigerant to a high temperature, high pressure refrigerant and discharges to the refrigerant discharge pipe 83*a* together with the oil, and most of the oil is separated from the refrigerant as the discharged refrigerant and oil passes through the oil separator 85, and a portion of the oil circulates the refrigerating cycle together with the refrigerant.

That is, the refrigerant passed through the oil separator passes through the 4-way valve 87*b*, the outdoor heat exchanger 82, the expansion device 88*a* in succession, and is introduced into the indoor heat exchanger of the indoor unit in cooling operation, vaporizes while cooling air around the indoor unit 72 such that the indoor unit serves as a cooler, and returns to the variable capacity compressor 83.

The oil separated from refrigerant at the oil separator 85 returns to the refrigerant suction pipe 83*b* of the variable capacity compressor 83 through the oil return pipe 156, and, therefrom to the variable capacity compressor 83 together with the refrigerant returning to the variable capacity compressor 83.

In the meantime, the multi-type air conditioner causes a non-uniform distribution of oil among the compressors 83, 84, 94, and 95 as oil in the refrigerating system concentrates on the variable capacity compressor 83 if operation of the variable capacity compressor 83 is continued for a long time period.

In this instance, the multi-type air conditioner of in accordance with a second preferred embodiment of the present invention performs an operation in which the oil is distributed uniformly among the compressors 83, 84, 93, and 94 at an exact time point through the equalizing pipe 150 having the branch pipes 151, 152, 153, and 154, and the connection pipe 155, and the temperature sensors 163, 164, 173, and 174 at the ends of the branch pipes 151, 152, 153, and 154, for preventing wear and noise from the compressors 83, 84, 93, and 94, extending lifetimes of the compressor 83, 84, 93, and 94, and improving a system efficiency.

Figure 8:
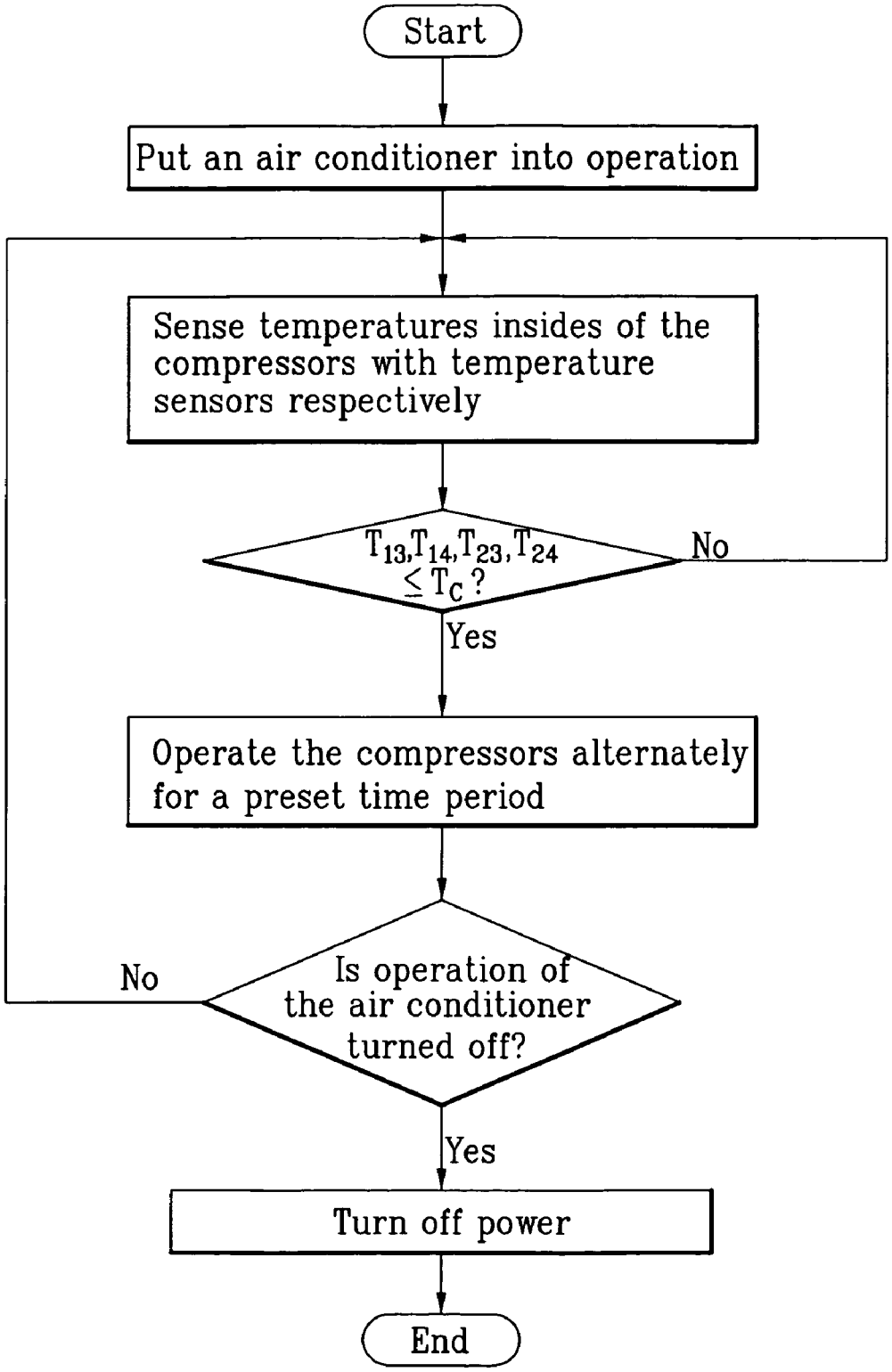
FIG. 8 illustrates a flow chart showing the steps of a method for controlling a multi-type air conditioner in accordance with a second preferred embodiment of the present invention.

That is, referring to FIG. 8, upon putting the multi-type air conditioner in accordance with a second preferred embodiment of the present invention into operation, the temperature sensors 163, 164, 173, and 174 at the ends of the branch pipes 151, 152, 153, and 154 sense temperatures inside of the compressors 83, 84, 93, and 94, respectively.

Then, the control unit (not shown) compares the temperatures T13, T14, T23, and T24 of the compressors 83, 84, 93, and 94 sensed with the temperature sensors 163, 164, 173, and 174 to a preset critical temperature Tc of the compressors 83, 84, 93, and 94. The critical temperature Tc is an inside temperature of the compressor when an amount of oil stored in the compressor is a minimum amount the compressor requires.

Accordingly, if one of the temperatures T13, T14, T23, and T24 of the compressors 83, 84, 93, and 94 drops below the critical temperature Tc of the compressors 83, 84, 93, and 94, an operation is performed for a predetermined time period to make oil distribution among the compressor 83, 84, 93, and 94 uniform.

For an example, by operating the compressors 83, 84, 93, and 94 alternately for the predetermined time period, the oil is transferred from the compressor 83 on which the oil is concentrated to the compressors 84, 93, and 94 which have shortage of oil.

Thus, by performing the operation for uniform distribution of oil among the compressors 83, 84, 93, and 94 at the exact time point at which the oil is distributed among the compressors 83, 84, 93, and 94 non-uniformly, not only the performance of the compressor 83, 84, 93, and 94 can be improved, but also system efficiency of the air conditioner having the compressors 83, 84, 93, and 94 can be improved.

In the meantime, if two, or more than two of the indoor units 51, 52, 53, 54, 61, 62, 63, and 64 are in operation, the first, second, and third single speed compressors 84, 93, and 94 are operated in correspondence to the load on the indoor units 51, 52, 53, 54, 61, 62, 63, and 64.

In this case too, the performance of the operation for uniform distribution of oil among the compressors 83, 84, 93, and 94 at the exact time point at which the oil is distributed among the compressors 83, 84, 93, and 94 non-uniformly, not only permits improvement of the performance of the compressors 83, 84, 93, and 94, but also permits improvement of system efficiency of the air conditioner having the compressors 83, 84, 93, and 94.

The multi-type air conditioner of the present invention has the following advantages.

First, the uniform distribution of oil among the compressors at an exact time point at which the oil is distributed among the compressors non-uniformly, not only permits improvement of the performance of the compressors, but also permits improvement of system efficiency of the air conditioner having the compressors.

Second, the performance of the operation for uniform distribution of oil among the compressors only at a time point at which the oil is distributed among the compressors non-uniformly permits to minimize power consumption, to reduce an energy consumption effectively.

The improvement of performance and efficiency of the multi-type air conditioner coming from improvement of the compressors permits to improve the cooling/heating performance of the multi-type air conditioner.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A multi-type air conditioner comprising:

at least one outdoor unit having a plurality of compressors for compressing refrigerant;

at least one indoor unit connected to the outdoor unit with refrigerant pipes;

a plurality of temperature sensors mounted in the plurality of compressors for sensing temperatures in the compressors, respectively;

an equalizing pipe in communication with the plurality of compressors, for uniform distribution of oil among the plurality of compressors according to the temperatures sensed at the plurality of temperature sensors; and a control unit receiving signals from the temperature sensors, the control unit comparing the oil temperature in each compressor and distributing oil between the compressors based on results of the comparison.

2. The multi-type air conditioner as claimed in claim 1, wherein the temperature sensors are mounted adjacent to the equalizing pipe in communication with insides of the compressors, respectively.

3. The multi-type air conditioner as claimed in claim 1, wherein the ends of the equalizing pipe are positioned at heights at least higher than a lowest oil level of the compressors.

4. The multi-type air conditioner as claimed in claim 1, wherein, if the multi-type air conditioner has one outdoor unit, the equalizing pipe includes branch pipes in communication with the plurality of compressors.

5. The multi-type air conditioner as claimed in claim 1, further comprising a plurality of outdoor units, wherein the equalizing pipe includes:

branch pipes in communication with the plurality of compressors in respective outdoor units, and connection pipes for making the plurality of the outdoor units in communication between the branch pipes.

6. The multi-type air conditioner as claimed in claim 1, further comprising a strainer in the equalizing pipe for separating foreign matters from flowing oil.

7. The multi-type air conditioner as claimed in claim 1, further comprising a plurality of outdoor units, one of the outdoor units includes the plurality of compressors having a variable capacity compressor of which capacity varies, and other one single speed compressor which is driven at a constant speed, and another of the outdoor units includes the plurality of compressors having the single speed compressors.

8. The multi-type air conditioner as claimed in claim 1, further comprising:

a plurality of oil separators in communication with the plurality of compressors for separating oil from refrigerant from the compressors respectively; and a plurality of oil return pipes respectively connected between the oil separators and compressors for guiding oil separated at the oil separators to the compressors.

9. The multi-type air conditioner as claimed in claim 8, wherein the oil return pipes are respectively connected to refrigerant suction pipes of the compressors into which refrigerant is drawn.

10. The multi-type air conditioner as claimed in claim 8, further comprising strainers in the oil return pipes for separating foreign matters from flowing oil.

11. The multi-type air conditioner as claimed in claim 8, wherein the refrigerant pipes connected between the outdoor unit and the indoor unit are parallel.

12. A method for controlling a multi-type air conditioner having at least one outdoor unit having a plurality of compressors for compressing refrigerant, at least one indoor unit connected to the outdoor unit with refrigerant pipes, a plurality of temperature sensors mounted in the plurality of compressors for sensing temperatures in the compressors respectively, and an equalizing pipe in communication with the plurality of compressors, for uniform distribution of oil among the plurality of compressors according to the temperatures sensed at the plurality of temperature sensors respectively, the method comprising:

sensing temperatures of insides of the plurality of compressors with the plurality of temperature sensors respectively;

comparing the sensed temperatures of the insides of the compressors to preset critical temperatures of the compressors, respectively; and distributing oil uniformly among the plurality of compressors according to a result of the comparison.

13. The method as claimed in claim 12, wherein the distributing step is performed when at least one temperature below the critical temperature in the temperatures sensed with the temperature sensors.

14. The method as claimed in claim 12, wherein the distributing step includes the step of operating the plurality of compressors alternately for a preset time period.

15. The method as claimed in claim 12, wherein the critical temperature is a temperature inside of the compressor when an amount of oil stored in the compressor is a minimum amount the compressor requires.

* * * * *